US005132501A

United States Patent [19]

Green

[11] Patent Number: 5,132,501

[45] Date of Patent: Jul. 21, 1992

[54] MICROWAVE POTATO HOLDER APPARATUS

[76] Inventor: William F. Green, P.O. Box 217, 1225 Whitehurst La., Nicoma Park, Okla. 73066-0217

[21] Appl. No.: 760,380

[22] Filed: Sep. 16, 1991

[51] Int. Cl.[5] ..... H05B 6/12; A23L 3/01

[52] U.S. Cl. ..... 219/10.55 E; 219/10.55 F; 99/DIG. 14; 426/234; 426/243

[58] Field of Search ..... 219/10.55 E, 10.55 R; 99/DIG. 16, 419, 451, 439, 441; 426/113, 234, 243, 523; 220/23.2, 23.4, 912; 211/88, 95, 153

[56] References Cited

U.S. PATENT DOCUMENTS

| | | | |
|---|---|---|---|
| 1,913,337 | 6/1933 | Manicke | 220/912 |
| 3,504,832 | 4/1970 | Corvetti | 211/88 |
| 4,081,646 | 3/1976 | Goltsos | 426/234 |
| 4,330,696 | 5/1982 | Pomeroy et al. | 219/10.55 F |
| 4,413,167 | 11/1983 | Martel et al. | 219/10.55 E |
| 4,483,446 | 11/1984 | Miller et al. | 211/153 |
| 4,590,351 | 5/1986 | Pomroy et al. | 219/10.55 F |
| 4,820,893 | 4/1989 | Mode | 219/10.55 F |
| 4,866,232 | 9/1989 | Stone | 219/10.55 E |

*Primary Examiner*—Geoffrey S. Evans
*Assistant Examiner*—Tuan Vinh To
*Attorney, Agent, or Firm*—Leon Gilden

[57] ABSTRACT

A microwave receptive device includes a plurality of trough members defined by arcuate side walls and a floor to receive a potato member therewithin to position and align a potato for a proper baking within a microwave oven. The holder may further include openings or slots directed through the troughs as an alternative construction and may further be positioned upon a rack structure to properly align and mount the holder medially of an oven structure. A further alternative to the device includes the holder rotatably mounted relative to a base housing to permit rotation of the potato holder member to enhance complete cooking of a potato member positioned therewithin.

1 Claim, 4 Drawing Sheets

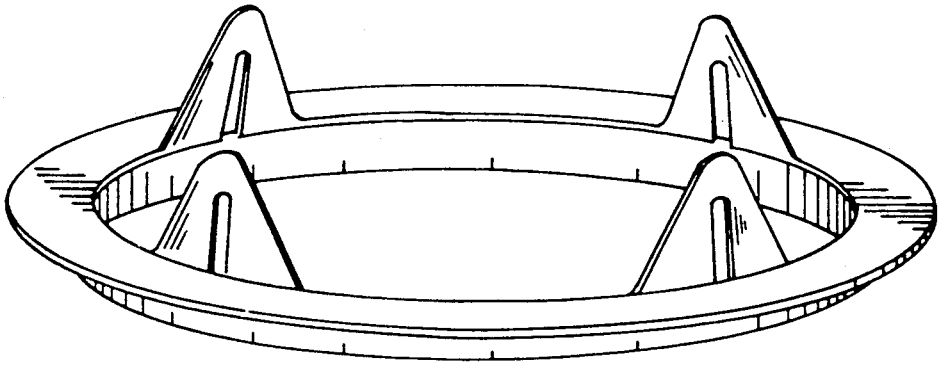
FIG 1
PRIOR ART
FIG 2
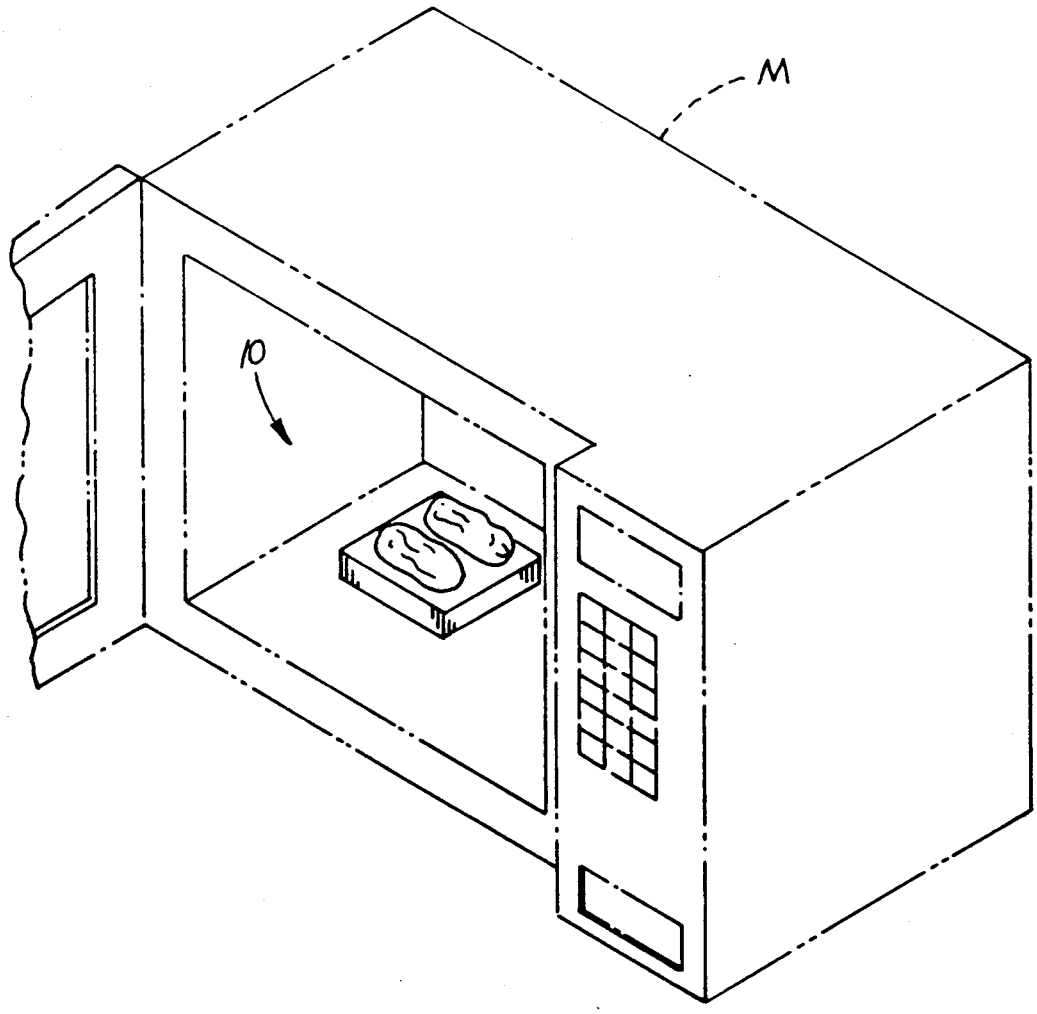

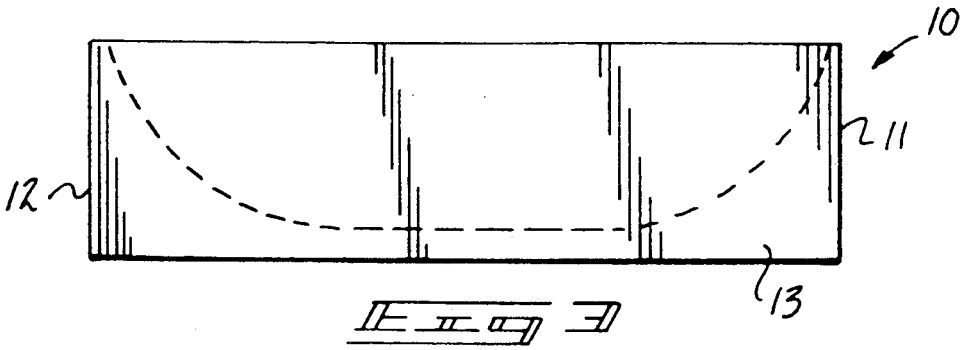
Fig 3
Fig 4
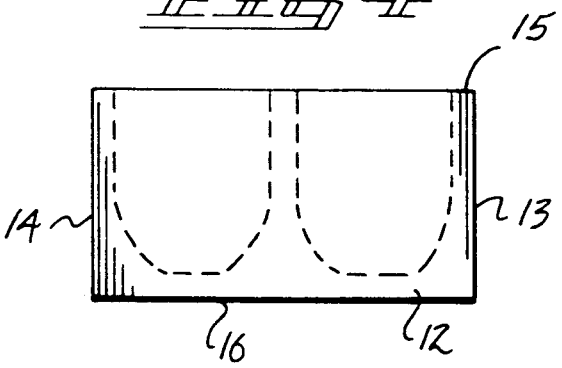
Fig 5
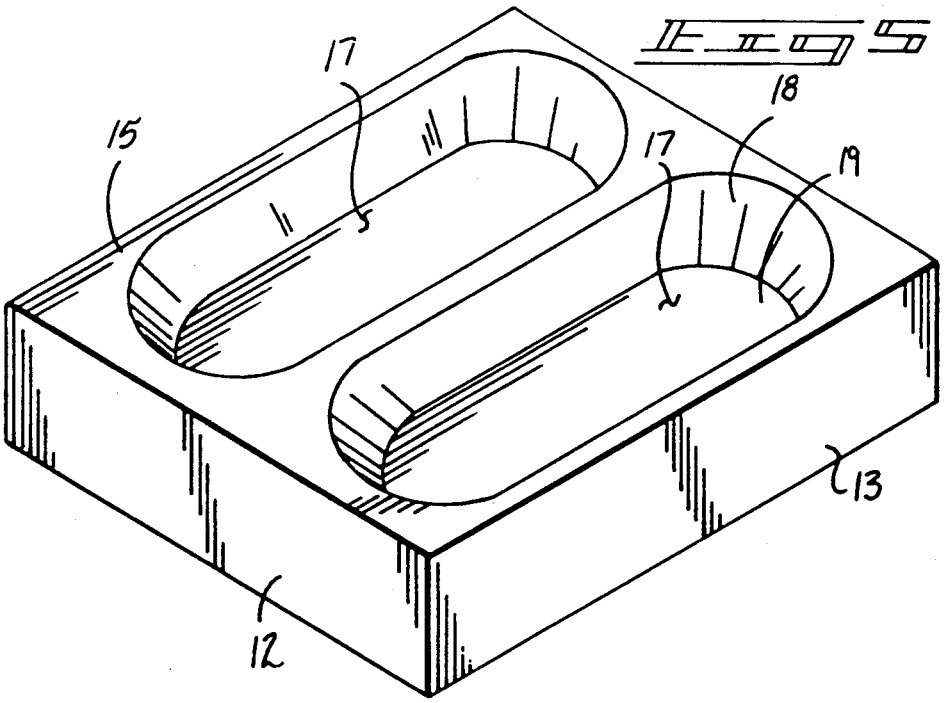

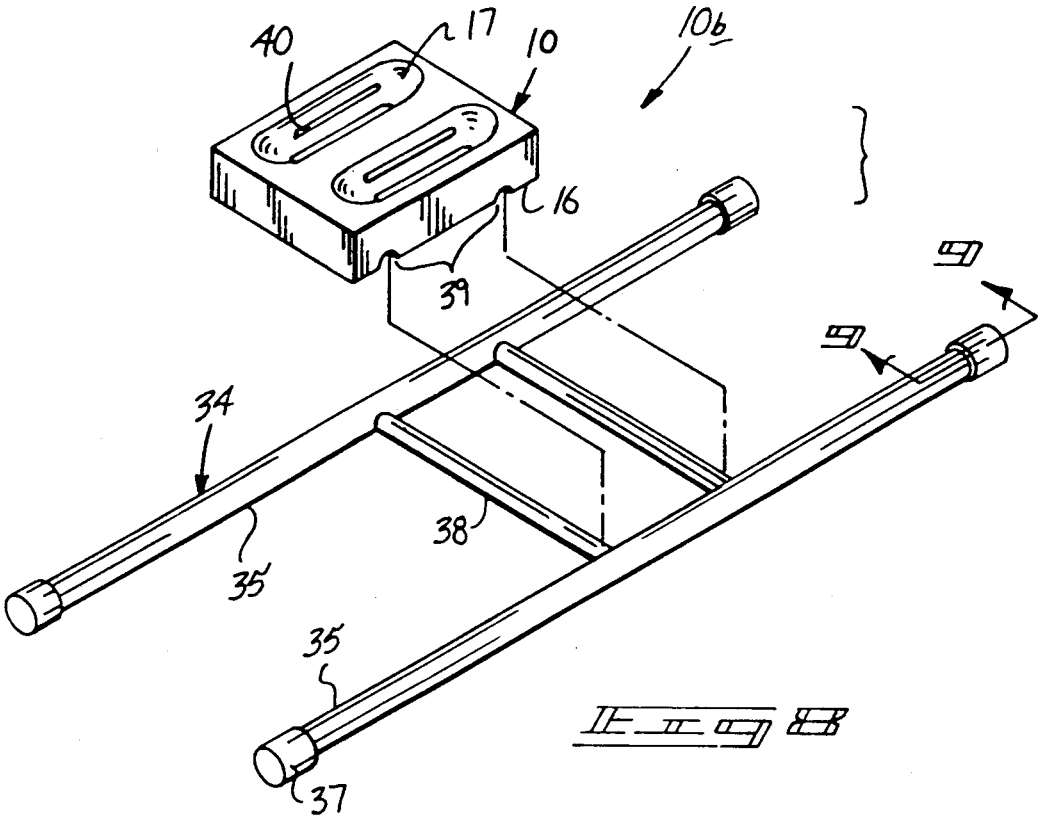
Fig 8
Fig 9
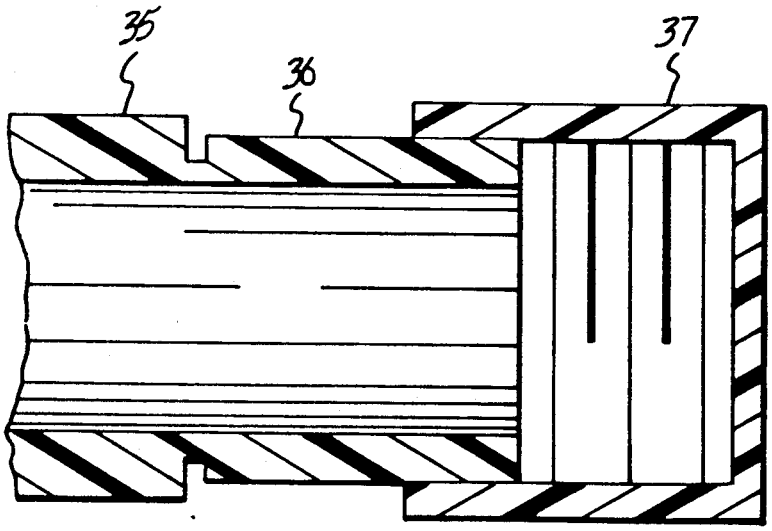

MICROWAVE POTATO HOLDER APPARATUS

BACKGROUND OF THE INVENTION

1. Field of the Invention

The field of invention relates to microwave cookware, and more particularly pertains to a new and improved microwave potato holder apparatus wherein the same is arranged for positioning of a potato within a support member.

2. Description of the Prior Art

Various microwave products are available in the prior art and products are directed to the baking of potatoes. Such apparatus is exemplified in U.S. Pat. No. 4,558,197 to Wyatt wherein a potato cooker includes a support plate to receive a plurality of potato members impaled upon projections on the apparatus.

U.S. Pat. No. 2,111,456 to Markle sets forth a poultry mounting device utilizing spike members to impale the poultry for positioning therewithin in a baking situation.

U.S. Pat. No. 4,896,011 to Trucks sets forth a microwave potato baking stand utilizing a rod to pierce and position a potato in a spaced relationship relative to a microwave floor.

U.S. Pat. No. 3,379,118 to Perez sets forth a baking rack for impaling and mounting potatoes thereon.

As such, it may be appreciated that there continues to be a need for a new and improved microwave potato holder apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of microwave cookware devices now present in the prior art, the present invention provides a microwave potato holder apparatus wherein the same is arranged for positioning a potato within a microwave oven for permitting its complete baking in a microwave cooking procedure. As such, the general purpose of the present invention, which will be described subsequently in greater detail, is to provide a new and improved microwave potato holder apparatus which has all the advantages of the prior art microwave cookware devices and none of the disadvantages.

To attain this, the present invention provides a microwave receptive device including a plurality of trough members defined by arcuate side walls and a floor to receive a potato member therewithin to position and align a potato for a proper baking within a microwave oven. The holder may further include openings or slots directed through the troughs as an alternative construction and may further be positioned upon a rack structure to properly align and mount the holder medially of an oven structure. A further alternative to the device includes the holder rotatably mounted relative to a base housing to permit rotation of the potato holder member to enhance complete cooking of a potato member positioned therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved microwave potato holder apparatus which has all the advantages of the prior art microwave cookware devices and none of the disadvantages.

It is another object of the present invention to provide a new and improved microwave potato holder apparatus which may be easily and efficiently manufactured and marketed.

It is a further object of the present invention to provide a new and improved microwave potato holder apparatus which is of a durable and reliable construction.

An even further object of the present invention is to provide a new and improved microwave potato holder apparatus which is susceptible of a low cost of manufacture with regard to both materials and labor, and which accordingly is then susceptible of low prices of sale to the consuming public, thereby making such microwave potato holder apparatus economically available to the buying public.

Still yet another object of the present invention is to provide a new and improved microwave potato holder apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art potato holder device.

FIG. 2 is an isometric illustration of the instant invention positioned within an associated microwave oven.

FIG. 3 is an orthographic side view of the instant invention.

FIG. 4 is an orthographic end view of the instant invention.

FIG. 5 is an isometric illustration of the instant invention.

FIG. 8 is an isometric illustration of a further modification of the invention.

FIG. 9 is an orthographic view, taken along the lines 9—9 of FIG. 8 in the direction indicated by the arrows.

DESCRIPTION OF THE PREFERRED EMBODIMENT

Figures 6, 7:
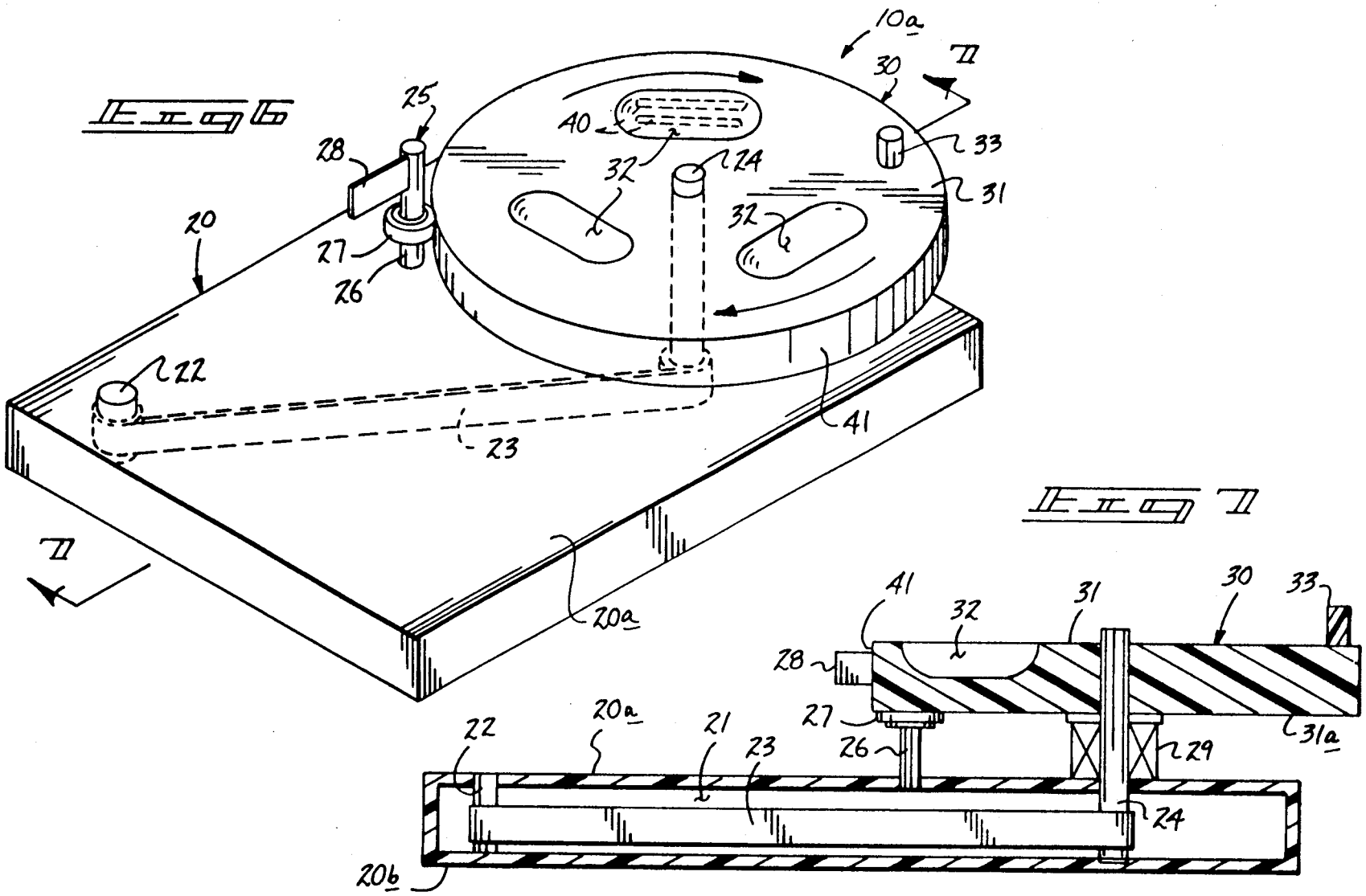
FIG. 6 is an isometric illustration of a modification of the invention.
FIG. 7 is an orthographic view, taken along the lines 7—7 of FIG. 6 in the direction indicated by the arrows.

With reference now to the drawings, and in particular to FIGS. 1 to 9 thereof, a new and improved microwave potato holder apparatus embodying the principles and concepts of the present invention and generally designated by the reference numerals 10, 10*a*, and 10*b* will be described.

FIG. 1 sets forth a prior art potato cooker for use in microwave ovens, as set forth in U.S. Pat. No. 4,558,197, wherein the ring member mounts a plurality of wedge-shaped blades extending upwardly thereof, wherein each blade is arranged for impaling a potato for its positioning within a microwave oven.

More specifically, the microwave potato holder apparatus 10 of the instant invention essentially comprises a support member, as illustrated in the FIGS. 2-5, to include a first end wall 11 spaced from a second end wall 12. A first side wall 13 is spaced from a second side wall 14, with a top wall 15 spaced from a bottom wall 16. The support member thereby is arranged to receive at least a plurality of concave troughs 17 directed into the support member through the top wall 15. Each trough 17 includes an arcuate trough side wall 18 converging into a trough floor 19 to position a potato therewithin. The side walls may include side wall slots 40, as illustrated in FIG. 8, and wherein the floor may be eliminated in construction of the organization.

The FIGS. 6 and 7 illustrate a modified apparatus 10*a*, wherein a base plate housing 20 includes a housing top wall 20*a* and a housing bottom wall 20*b* defining a housing cavity 21 therebetween. A first axle 22 is fixedly and orthogonally mounted between the housing top wall 20*a* and the housing bottom wall 20*b* spaced from and parallel a second axle 24 that extends from the housing bottom wall 20*b* and projects orthogonally above the housing top wall 20*a*. An elastomeric band 23 includes a rear distal end fixedly secured to the first axle 22, with the first axle 22 as noted fixedly mounted within the housing 20, with the second axle 24 rotatably mounted within the housing about a support bearing 29 mounted to the housing top wall and supporting a rotary support plate 30 mounted to an upper end portion of the rotary support bearing 29, with the support plate 30 fixedly secured to an upper portion of the second axle 24 above the support bearing 29. The forward distal end of the elastomeric band 23 secured to the second axle 24 permits its winding about the second axle 24 upon rotation of the support plate 30. A manual grasping dowel 33 is mounted to a support plate top wall 31 adjacent a perimeter edge of the support plate 30 to ease rotation of the support plate 30 and the associated second axle 24 rotatably mounted within the base housing 20.

A cam lock 25 is mounted for cooperation with a support plate side wall 41, wherein the cam lock 25 includes a cam lock shaft 26 rotatably mounted to the housing 20 and rotatably to the housing top wall 20*a*. The shaft 26 includes a cam plate 27 positioned adjacent the support plate side wall 41 and extending diametrically beyond the support shaft 26. A cam lock shaft handle 28 permits selective pivotment of the cam lock 25 relative to the support plate side wall 41 to selectively engage the cam plate 27 relative to the side wall, whereupon subsequent to a winding of the support plate 30 to wind the elastomeric band 23 about the second axle 24, disengagement of the cam plate 27 relative to the support plate side wall 41 permits rotation of the support plate 30, wherein the cam plate 27 may be arranged to impart slight frictional engagement with the side wall 41 to control rate of rotation of the support plate 30 relative to the base housing 20.

The support plate bottom wall 31*a* is spaced from the housing top wall 20*a* to, as illustrated, to provide positioning and orientation of the support bearing 29 therebetween and further permit access to heating in an appropriate manner of a potato member that may be positioned within the troughs 32. To this end, the side wall slots 40, as illustrated in FIG. 8, may also be provided within the troughs 32.

The embodiment 10*b*, as illustrated in FIGS. 8 and 9, includes a support rack 34 for mounting the support member thereon, wherein the bottom wall 16 includes a plurality of spaced parallel grooves 39 spaced apart a predetermined spacing. The support rack 34 includes a plurality of support rack legs 35 secured together by a plurality of cross bars 38 orthogonally oriented relative to the support legs 35 and spaced apart a predetermined spacing to be received complementarily within the grooves 39. Each distal end of the support rack legs 35 includes a threaded extension tube 36 (see FIG. 9) threadedly receivable within an internally threaded socket 37 to permit extension of the socket that is formed with a resilient covering for engagement to side walls of the associated microwave oven "M", such as typified in the FIG. 2, to position and align medially of the microwave oven "M" the apparatus 10*b*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cookware apparatus arranged for receiving and positioning a potato member within a microwave appliance, wherein the apparatus comprises.

a base housing, the base housing including a housing top wall and a housing bottom wall defining a housing cavity between the housing top wall and the housing bottom wall, and a support member, the support member including mounting means for rotatably mounting the support member above the housing top wall, and the mounting means includes a first axle, the first axle fixedly mounted within the housing cavity between the housing top wall and the housing bottom wall, and the mounting means further including a second axle spaced from and parallel the first axle, wherein the second axle includes a second axle upper distal end, wherein the upper distal end projects above the housing top wall, and the support member including a cylindrical side wall, a top wall spaced from and parallel to a bottom wall, and a support bearing, the support bearing in contiguous communication with the housing top wall and the bottom wall of the support member, and the second axle projecting through the support bearing and the second axle fixedly mounting the support member adjacent the second axle upper distal end to position and space the housing bottom wall relative to the support member bottom wall, and the mounting means further including an elastomeric band, the elastomeric band including a band first end and an elastomeric second end, the elastomeric band first end fixedly mounted to the first axle, and the elastomeric band second end fixedly mounted to the second axle, whereupon rotation of the second axle relative to the support housing effects winding of the elastomeric band about the second axle, and a cam lock, the cam lock including a cam lock shaft rotatably mounted to the housing top wall arranged parallel to the second axle, and the cam lock shaft including a cam plate, the cam plate positioned adjacent the support member side wall and arranged for contiguous communication with the side wall in a first position and spaced from the side wall in a second position, and the cam lock shaft including a cam lock shaft handle mounted adjacent an upper terminal end of the cam lock shaft, and a dowel member projecting above the support member top wall adjacent the support member side wall arranged for manual grasping of the dowel enhancing ease of rotation of the support member, and a plurality of circumferentially aligned troughs at equal distance radially about the second axle and directed into the support member from the support member top wall.

* * * * *